US009902470B1

(12) United States Patent
Jankowski

(10) Patent No.: US 9,902,470 B1
(45) Date of Patent: Feb. 27, 2018

(54) LIFEBOAT LAUNCHING ARRANGEMENT

(71) Applicant: Jacek Jankowski, Warsaw (PL)

(72) Inventor: Jacek Jankowski, Warsaw (PL)

( * ) Notice: Subject to any disclaimer, the term of this patent is extended or adjusted under 35 U.S.C. 154(b) by 0 days.

(21) Appl. No.: 15/254,189

(22) Filed: Sep. 1, 2016

(51) Int. Cl.

| | |
|---|---|
| ***B63B 23/00*** | (2006.01) |
| ***B63B 23/28*** | (2006.01) |
| ***B63B 23/02*** | (2006.01) |
| ***B63B 23/48*** | (2006.01) |

(52) U.S. Cl.
CPC ..... *B63B 23/28* (2013.01); *B63B 23/02* (2013.01); *B63B 23/48* (2013.01); *B63B 2713/00* (2013.01); *B63B 2728/00* (2013.01)

(58) Field of Classification Search
CPC ..... B63B 23/02; B63B 23/30; B63B 23/48; B63B 2728/00; B63B 23/00; B63B 23/04; B63B 23/06; B63B 23/28; B63B 23/40; B63B 23/60; B63B 2713/00
USPC ..... 114/348, 349, 365–380
See application file for complete search history.

(56) References Cited

U.S. PATENT DOCUMENTS 2,103,708 A * 12/1937 Campbell ..... B63B 23/26 114/365
2,141,181 A * 12/1938 Bel Geddes ..... B63B 1/04 114/259
2,540,535 A * 2/1951 Kuhler ..... B63B 23/04 114/372
4,406,244 A 9/1983 Buchan et al.
4,660,677 A * 4/1987 Hunter ..... A62B 1/20 114/366
4,676,185 A * 6/1987 Bergman ..... B63B 23/28 114/348
4,781,144 A * 11/1988 O'Brien ..... B63B 23/32 114/365
5,706,755 A * 1/1998 O'Brien ..... B63B 27/10 114/365
2003/0221605 A1 12/2003 Re et al.
2007/0006790 A1 1/2007 Dronne et al.
2012/0125252 A1 5/2012 Nielsen
2013/0291779 A1 11/2013 Clarke
2016/0221644 A1 8/2016 Porak
2016/0221645 A1 8/2016 Kalve

* cited by examiner

*Primary Examiner* — Daniel V Venne
(74) *Attorney, Agent, or Firm* — Eversheds Sutherland (US) LLP

(57) ABSTRACT

The present application provides a launching arrangement for a lifeboat from an offshore installation. The launching arrangement may include a garage for the lifeboat, a gate of the garage that can be opened by gravity, wherein the lifeboat can be launched either as a free fall lifeboat or by a fall of a lifeboat winch in case of an emergency situation and while a power supply is off, and wherein the garage is equipped with the gate with a wire rope winch, a lower hydraulic cylinder, and an upper hydraulic cylinder; and the gate of the garage opens by gravity by simultaneous operation of a wire rope winch of the gate and the lower hydraulic cylinder and the upper hydraulic cylinder, both hydraulic cylinders working as a closed hydraulic system; and the lower hydraulic cylinder and the upper hydraulic cylinder including piston rods.

14 Claims, 7 Drawing Sheets

LIFEBOAT LAUNCHING ARRANGEMENT

TECHNICAL FIELD

The present application and the resultant patent relate generally to lifeboats and more particularly relate to a lifeboat launching arrangement from an offshore installation or other location

BACKGROUND OF THE INVENTION

There are lifeboat launching appliances from offshore installations, wherein the lifeboat can be launched as a free fall lifeboat or wherein the lifeboat can be launched by falls. The free fall lifeboat launching from an oil rig usually means that the lifeboat is stored on a tilted ramp and can be slid through the ramp into the water under its own weight if a holdback is released. The lifeboat can be recovered usually by a hydraulic davit and a spreader of a wire rope winch. The lifeboat may be attached to spreader chains by two pairs of slings. The lifeboat launching from an oil rig by falling under gravity usually means that the lifeboat is stored above sea level and can be lowered into the water by fall of a winch under its own weight if a brake of the winch is released. The lifeboat can be recovered by the opposite operation of the same wire rope winch.

A disadvantage of the present lifeboat launching systems from an oil rig is that in the case of the emergency situation and while the power supply is off, the lifeboat of one lifeboat launching system can be launched as only a free fall lifeboat or as only a conventional lifeboat by falls. Due to an obligation to ensure that people can abandon the oil rig safely with the use of the lifeboat in any circumstances whatsoever, in the event of a life threat, an oil rig may have both of these two different lifeboat launching systems. Such duplicate systems, however, increases the cost of the system and the cost of its service.

Although being the most effective, a disadvantage of the present free fall lifeboat launching system from an oil rig is that the free fall lifeboat launching system is not safe in certain circumstances. An example of such circumstances is the need to abandon an oil rig by the free fall lifeboat while the sea is covered by ice or the wreckage of the oil rig damaged by explosion and the like, wherein the risk of damage or breakdown of the lifeboat is high, particularly while visibility is reduced or when at night. The evacuation of injured people whose transport requires immobilization also should not be carried out by the free fall lifeboat if another, more appropriate, solution may exists. A disadvantage of the present lifeboat launching by gravity by falling from the oil rig is that, for some circumstances such as a high sea, if the lifeboat release mechanism malfunctions, manual disengagement may not be safe or even feasible.

A common disadvantage of both lifeboat launching systems is that usually the lifeboat launching arrangement is located on the open deck of oil rig. This location may reduce the safe abandonment of the oil rig during bad weather, fire and explosion, and, due to the direct exposure to the weather conditions, may cause a reduction in the efficiency of system operation and may increase the cost of service. Moreover during winter time, the freezing weather or snow may be the cause of the unsuitability of the lifeboat launching appliance for immediate use. Likewise, marine environment pollution may result as a result of wire ropes and moveable part bearings greasing.

SUMMARY OF THE INVENTION

The present application provides a launching arrangement for a lifeboat from an offshore installation. The launching arrangement may include a garage for the lifeboat, a gate of the garage that can be opened by gravity, wherein the lifeboat can be launched either as a free fall lifeboat or by a fall of a lifeboat winch in case of an emergency situation and while a power supply is off, and wherein lifeboat launching methods can be used interchangeably.

The lifeboat launching appliance and the lifeboat described herein are located in a garage that can be opened by gravity. The lifeboat can be launched either as a free fall lifeboat or by fall of the lifeboat winch in case of an emergency situation and while the power supply is off. The lifeboat launching can be selected depending on the circumstances of the emergency situation. An advantage herein is that the test of the lifeboat release mechanism for both lifeboat launching systems can be carried out while the lifeboat is located and secured at the ramp, and the test of the moveable parts for both lifeboat launching systems can be carried out while the lifeboat is unmanned.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
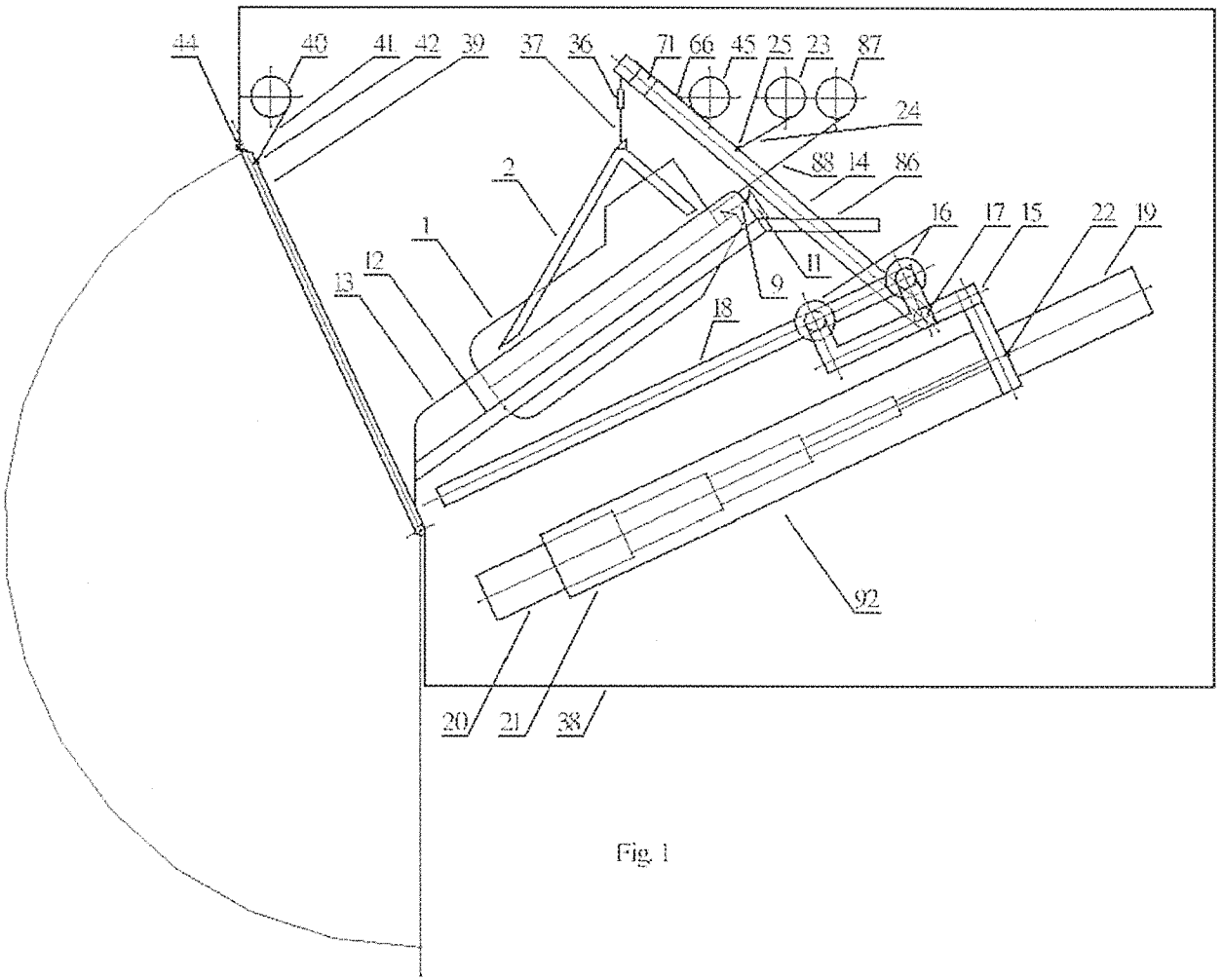
FIG. 1 is a side view of the lifeboat launching appliance corresponding to the situation while the lifeboat is ready for launching.
Figure 2:
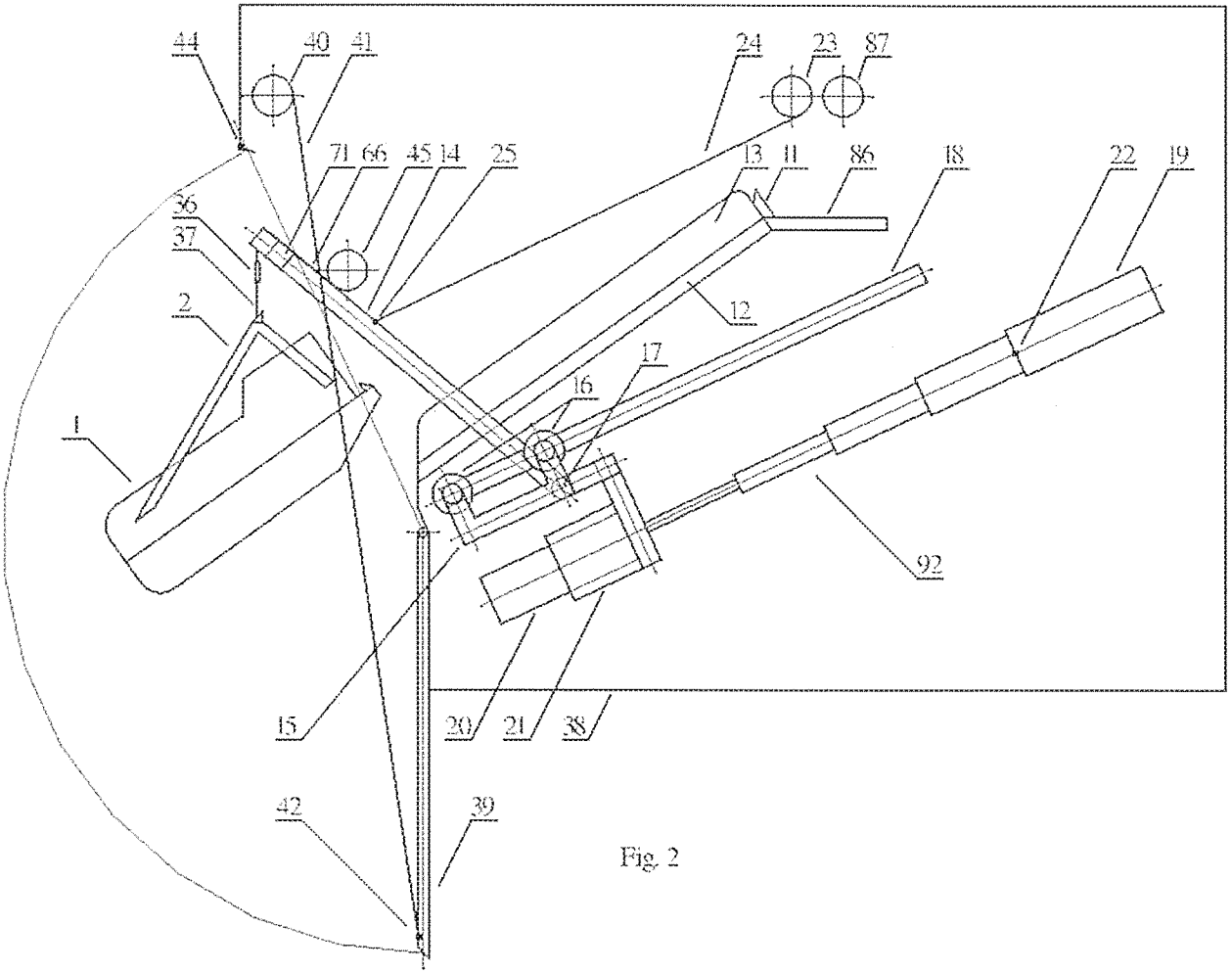
FIG. 2 is a side view of the lifeboat launching appliance corresponding to the situation while the lifeboat is outside the garage.
Figure 3:
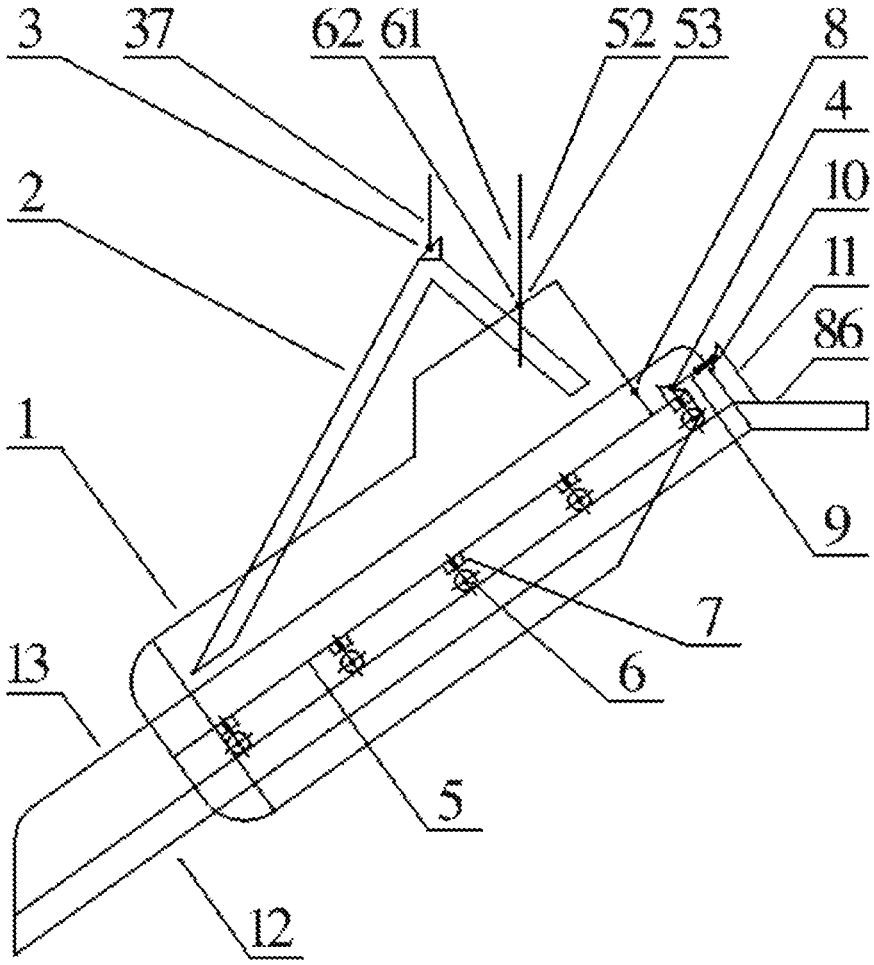
FIG. 3 is a side view of the lifeboat corresponding to the situation while the lifeboat is ready for launching.
Figure 4:
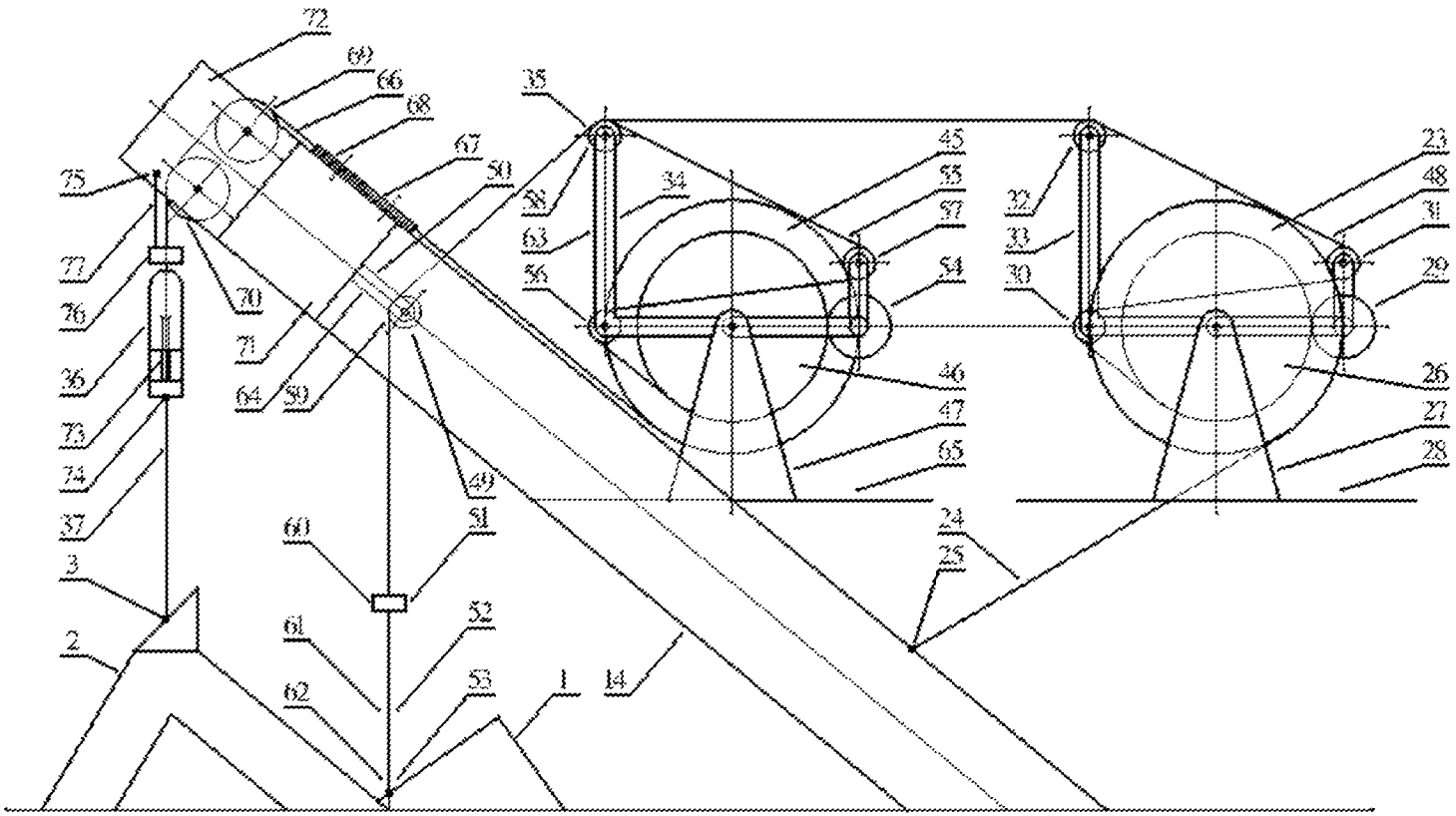
FIG. 4 is a side view of the upper part of the lifeboat davit corresponding to the situation while the lifeboat is ready for launching.
Figure 5:
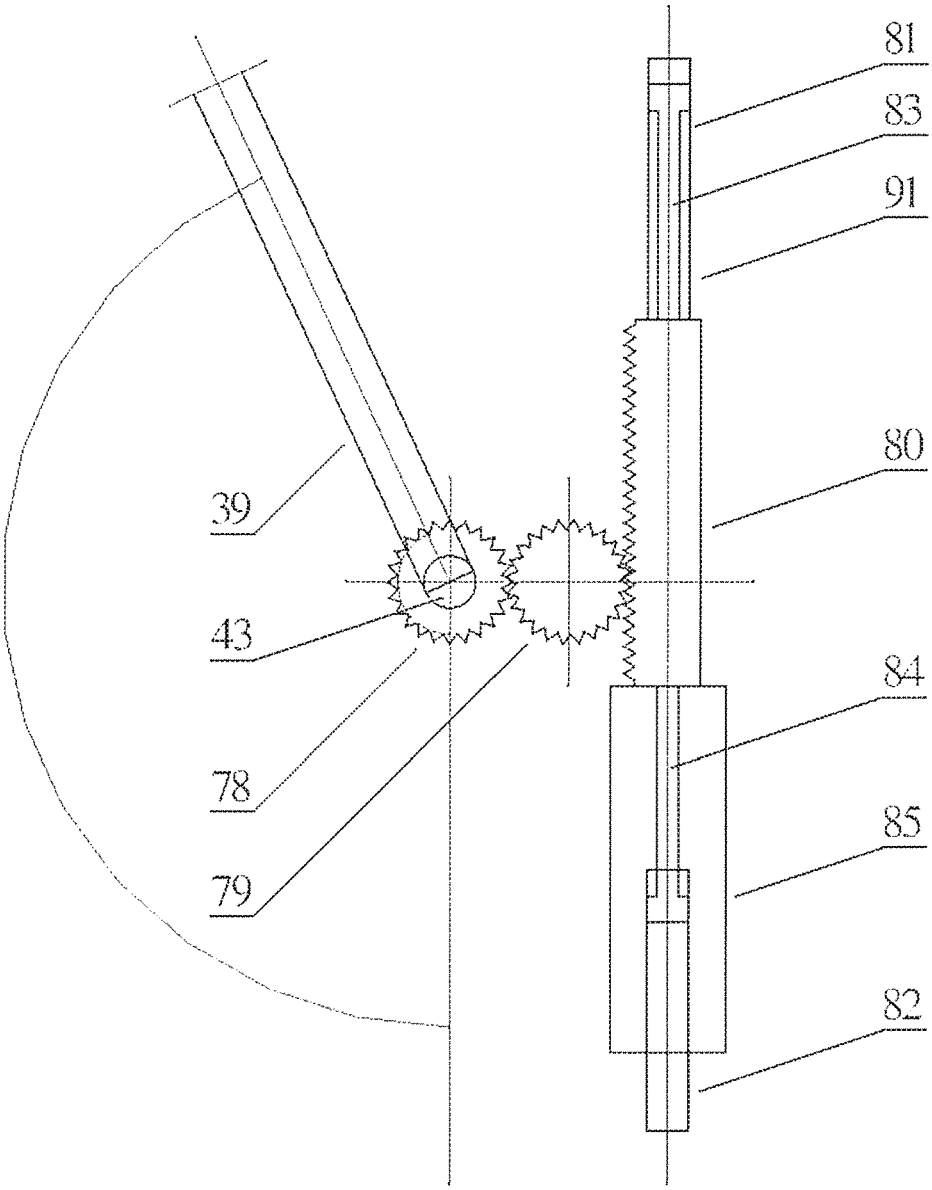
FIG. 5 is a side view of the garage gate device corresponding to the situation while the garage is closed.
Figure 6:
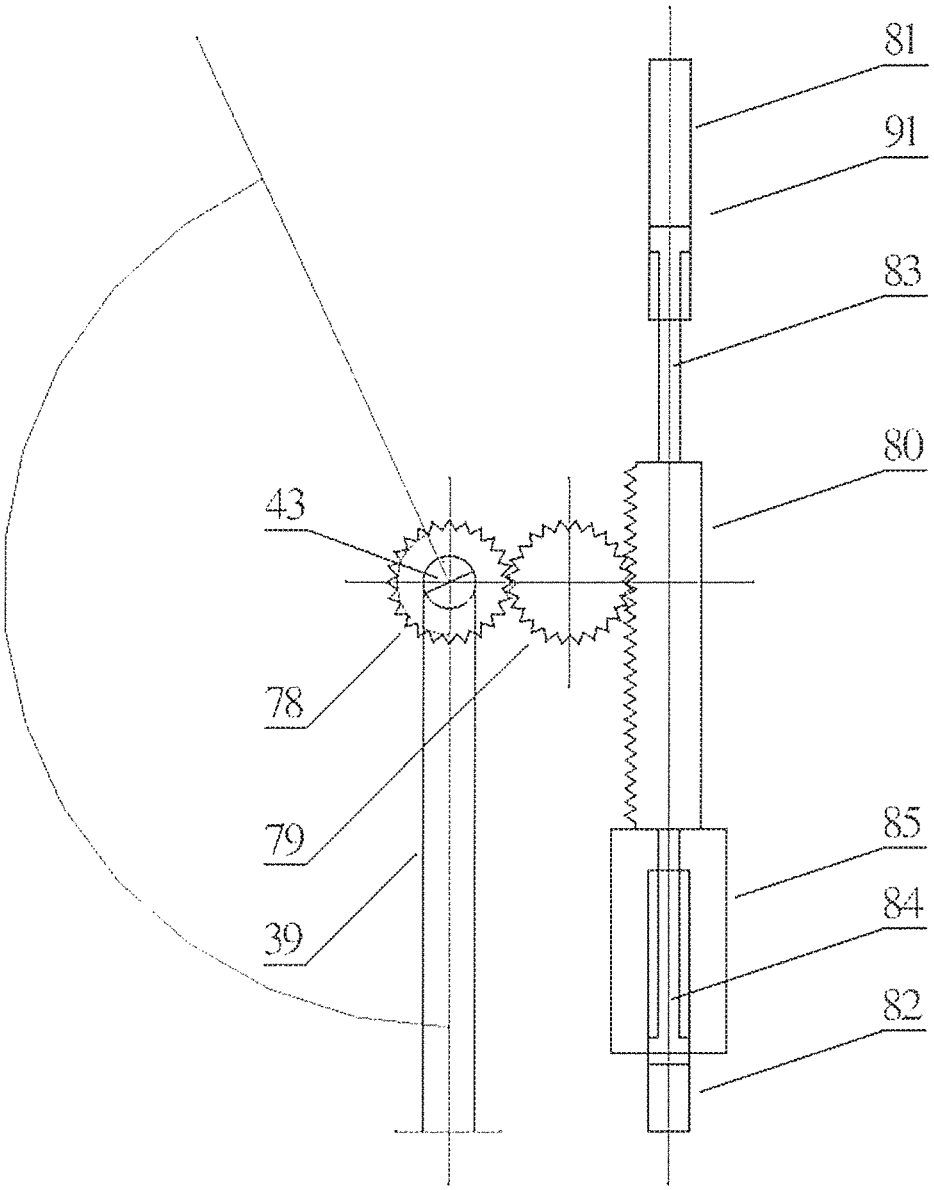
FIG. 6 is a side view of the garage gate device corresponding to the situation while the garage is open.
Figure 7:
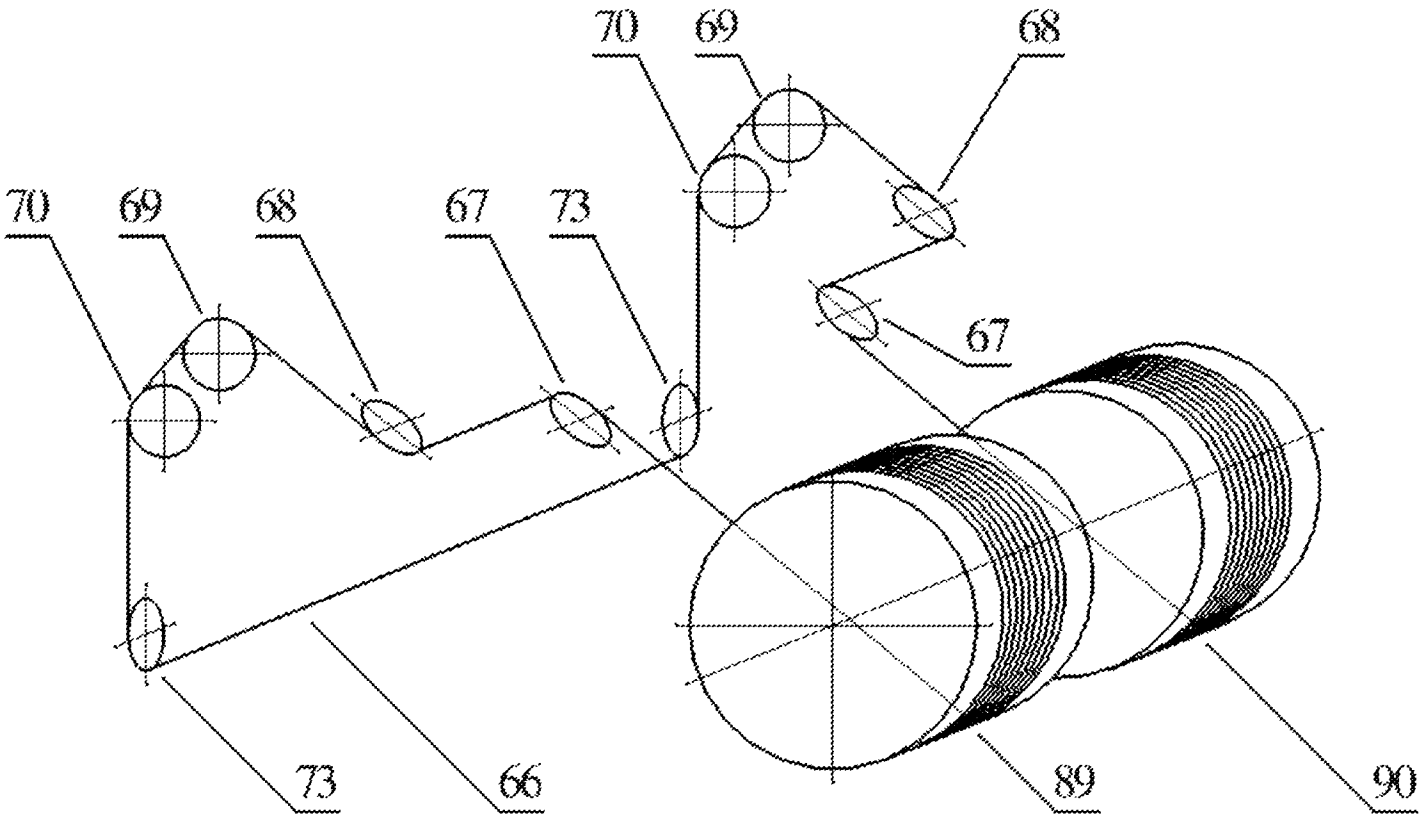
FIG. 7 shows a diagram of the layout of the lifeboat winch wire rope known as the fall.

Referring now to the drawing in which like numerals reflect like elements throughout the several views, FIG. 1 shows an example of a lifeboat launching appliance and a lifeboat 1 in a garage 38 as may be described herein. The garage 38 has a gate 39 that can be opened by gravity under its own weight. The lifeboat 1 may be launched either as a free fall lifeboat 1 or by a fall 66 of a lifeboat winch 45.

The garage 38 is equipped with the gate 39 with a wire rope winch 40, a lower hydraulic cylinder 82 and an upper hydraulic cylinder 81. The gate 39 opens by gravity by simultaneous operation of a wire rope winch 40, a lower hydraulic cylinder 82 and an upper hydraulic cylinder 81. Both lower hydraulic cylinder 82 and upper hydraulic cylinder 81 comprise piston rods 84 and 83. The gate 39 is in an inclined position while the garage 38 is closed. The gate 39 may be opened by gravity under its weigh and by the simultaneous operation of a wire rope winch 40 and a hydraulic cylinder device. The hydraulic cylinder device may include two identical hydraulic cylinders, a lower hydraulic cylinder 82 and an upper hydraulic cylinder 81. Each wire rope 41 of the winch 40 is connected to the sides of the gate 39 in its upper part by rotatable links 42. The two hydraulic cylinders 82 and 81 are working in a way of a closed hydraulic system and cylinders 82 and 81 operate in opposite directions in relation one to another. Piston rods 84 and 83 of the respective hydraulic cylinders 82 and 81 are in contact with two opposite ends of a gear bar 80. The gear bar 80 operates together with a gearwheel 78 of a gate axle 43 by an additional and identical gearwheel 79. The arrangement of the hydraulic cylinders 82, 81 and the gearwheels 78, 79 and the gear bar 80 is such that the length of the gear bar 80 on which the gearwheel 79 moves is longer than the stroke of the hydraulic cylinders 82 and 81 while opening the gate 39, and also that the stroke of hydraulic cylinders 82 and 81 is at least of the same length or longer than the arc length of the gearwheel 78 marked by the angle lines while the gate 39 is closed and fully open. The piston rod 84 of the lower hydraulic cylinder 82 is put out completely and the piston rod 83 of the upper hydraulic cylinder 81 is put in completely while the gate 39 is closed. The piston rod 84 of the lower hydraulic cylinder 82 is protected by a folding cover 85.

The opening of the garage gate 39 starts while a brake of the winch 40 is released. The opening speed of the gate 39 depends on the movement speed of the lower hydraulic cylinder piston rod 84. The possibility to determine the movement speed of the hydraulic cylinder piston rods 84 and 83 allows designating a safe speed of the gate 39 opening. The piston rod 84 of the lower hydraulic cylinder 82 is put in and the piston rod 83 of the upper hydraulic cylinder 81 is put out while the gate 39 is open. The piston rods 84 and 83 set a movement speed for the opening of the gate 39. The piston rods 84 and 83 are shifted by the arc length of the gear-wheel 78 marked by the angle lines while the gate 39 is closed and open.

The possibility to use the mechanical lock for the opposite movement of the gate 39 allows securing the gate 39 in case of one-way movement during the opening of the gate 39 and also securing the gate 39 position while the gate 39 is open. The gate 39 can be closed by the wire rope winch 40 while the mechanical lock for the opposite movement of the gate 39 is released. The closing position of the gate 39 is marked by a power supply limit switch 44 of the wire rope winch 40. The limit switch 44 cuts off the power supply for the wire rope winch 40 while the piston rod 83 of the upper hydraulic cylinder 81 is put in completely.

The lifeboat 1 is equipped with two identical triangular frames 2 on both sides. The frames 2 fulfil the function of the solid slings. There is one hook 3 of the lifeboat release gear at the top of each frame 2 for lifeboat launching gravity system by the fall 66 of the winch 45. The lifeboat 1 is attached to two chains 37 of a davit spreader 36 by two hooks 3. Each chain 37 is connected to the spreader 36 by rotatable links 74. Each hook release gear is connected to a central release unit of the hooks 3 by the release cables. The central release unit of the hooks 3 is located inside the lifeboat 1. The release cables are known as the Morse cables. The release cables of the respective hooks 3 are located inside each frame 2. The operation of the hook 3 release gears is simultaneous and protected by the hydrostatic unit.

There is an aft hook 4 of the release gear at the lifeboat stem for free fall lifeboat launching system. The lifeboat 1 is held at a ramp 12 by a chain 9. The chain 9 is connected to the aft hook 4. The aft hook 4 is released from the chain 9 by the control unit. The control unit is inside the lifeboat 1.

The lifeboat 1 is equipped with its own vertical rollers 6 and horizontal rollers 7. The rollers 6 and 7 are located below an outer lifeboat deck 5 on both sides of the lifeboat 1. The vertical rollers 6 provide the lifeboat movement through the ramp 12. The horizontal rollers 7 and ramp guides 13 ensure stabilization of the lifeboat movement through the ramp 12. There is also an aft hook 8 at the lifeboat stern for a wire rope 88 of an auxiliary winch 87. The auxiliary winch 87 is used for the lifeboat launching system test and in order to set the lifeboat 1 at the ramp 12 in the position ready for launching. There is a deck 86 of the ramp 12 for the lifeboat 1 embarkation.

The lifeboat 1 is ready to launch while the gate 39 of the garage 38 is open, and the lifeboat 1 is stored at the ramp 12 at a position marked by a power supply limit switch 22 of a lifeboat davit wire rope winch 23, and all lifeboat vertical rollers 6 are touching the ramp 12, and the spreader 36 chains 37 are tight, and the chain 9 that is used to hold the lifeboat 1 on the ramp 12 is tight.

The lifeboat 1 will be launched as the free fall lifeboat 1 if the following steps are carried out in the following order: both hooks 3 are released from the spreader chains 37, and the aft hook 4 is released from the chain 9 that is used to hold the lifeboat 1 on the ramp 12. The lifeboat 1 slides through tilted ramp 12 by the vertical rollers 6 and afterwards, as a result of that operation, freely falls into water. The horizontal rollers 7 and the ramp guides 13 ensure stabilization of the lifeboat 1 when it leaves from the ramp 12. In case of the aft hook 4 release gear failure, the aft hook 4 can be released, by emergency, from the inside of the lifeboat 1.

The lifeboat 1 will be launched by gravity by the fall 66 of the winch 45 if the following steps are carried out in the following order: the aft hook 4 is released from the chain 9 that is used to hold the lifeboat 1 on the ramp 12, and the lifeboat 1 is moved from the garage 38 to a position above sea level, and the lifeboat 1 is lowered into water by the fall 66 of the winch 45, and finally both hooks 3 are released from the spreader chains 37. The lifeboat 1 is held on the ramp 12 by the spreader chains 37 while the aft hook 4 is released from the chain 9. The fall 66 of the lifeboat winch 45 operates on two sheaves 73 of the spreader 36.

The lifeboat 1 can be moved out from the garage 38 by a lifeboat davit 14, the wire rope winch 23 and the device of two identical telescopic hydraulic cylinders, a lower telescopic hydraulic cylinder 20 and an upper telescopic hydraulic cylinder 19. The lifeboat davit 14 is moved by trolleys 15 and rail guides 18. The rail guides 18 are located on both sides of the lifeboat 1. The lower telescopic hydraulic cylinder 20 and the upper telescopic hydraulic cylinder 19 are working in a way of a closed hydraulic system and cylinders 20 and 19 operate in opposite directions in relation one to another. The inclination of the ramp 12 is bigger than the inclination of the rail guides 18. The wire rope winch 23 of the lifeboat davit 14 is located at a holder 27 of a garage stage 28. Each wire rope 24 of the winch 23 is connected to a respective arm of the lifeboat davit 14 by rotatable links 25. The forehead of each of the telescopic hydraulic cylinders 20, 19 is in contact with the lifeboat davit 14. The telescopic hydraulic cylinders 20, 19 contact the lifeboat davit 14 from two opposite sides and are in line to the movement of the lifeboat davit 14. Each trolley 15 is connected to a lower bar 17 of the lifeboat davit 14 and each trolley 15 is equipped with two rollers 16. The lifeboat davit 14 and the lifeboat 1 can be moved from the garage 38 to the position above sea level if a brake of the wire rope winch 23 is released. The lifeboat davit 14 is moved by the trolleys 15. The lifeboat 1 is attached to the spreader chains 37. The brake of the wire rope winch 23 may be released if the brake lever 29 is hoisted. The brake may be released from the inside of the lifeboat 1 by a control wire rope 48 or manually from the position of the winch 23. The lifeboat davit 14 movement from the garage 38 can be stopped any time by the control wire rope 48. The control wire rope 48 operates from the control wire rope drum 26 of the winch 23 to the inside of the lifeboat 1 on sheaves 30, 31, 32, 35 and 49, wherein the sheaves 30 and 32 are located at a winch holder 33, the sheave 31 is located at a brake lever 29 of the winch 23, the sheave 35 is located at a winch holder 34, and the sheave 49 is located at a holder 50 at an upper horizontal bar 71 of the lifeboat davit 14. There is a weight 51 and a control rope 52 at the end of the control wire rope 48. The control rope 52 goes to the inside of the lifeboat 1 through a hole 53.

The exit speed of the lifeboat davit 14 from the garage 38 depends on the closing speed of lower telescopic hydraulic cylinder 20. The possibility to determine the movement speed of the telescopic hydraulic cylinders 20, 19 allows designating a safe speed of the lifeboat davit 14 movement during the lifeboat 1 departure from the garage 38 to the position above sea level. The upper telescopic hydraulic cylinder 19 is fully closed and the lower telescopic hydraulic cylinder 20 is fully open while the lifeboat 1 is ready to move out from the garage 38. The lower telescopic hydraulic cylinder 20 is protected by a folding cover 21. The lower telescopic hydraulic cylinder 20 is closed and the upper telescopic hydraulic cylinder 19 is open while a brake of the winch 23 is released. The length of the telescopic hydraulic cylinders 20 and 19 changes equally to a distance made by the lifeboat davit 14 in the rail guides 18 while the lifeboat 1 is put into the garage 38 and put out from the garage 38. The possibility to use the mechanical lock for the lifeboat davit 14 allows securing the lifeboat davit 14 at a lower part of the rail guides 18 while the lifeboat 1 is outside the garage 38. The arrangement of the telescopic hydraulic cylinders 20, 19 and the rail guides 18 is such that the length of the rail guides 18 is at least the same as the length of or longer than the total stroke of the telescopic hydraulic cylinders 20, 19 necessary in order to put out the lifeboat 1 from the garage 38 to the position above sea level. The length of the rail guides 18 does not include the length of the trolleys 15 in the above calculation. The total stroke of the telescopic hydraulic cylinders 20, 19 is equal to a distance made by the lifeboat davit 14 in the rail guides 18 necessary in order to put out the lifeboat 1 from the garage 38 to the position above sea level.

The lifeboat 1 can be lowered into water if a brake of the wire rope winch 45 is released. The wire rope winch 45 of the lifeboat 1 is located at a holder 47 of the lifeboat davit stage 65. The fall 66 operates from one drum 89 of the winch 45 to a second drum 90 of the winch 45 on two pairs of vertical sheaves 69, 70 and on two pairs of horizontal sheaves 67, 68 of the lifeboat davit 14 and on two sheaves 73 of the spreader 36. The lifeboat 1 is attached to two chains 37 of the spreader 36 by two hooks 3. Two pairs of vertical sheaves 69, 70 are located at holders 72. Two pairs of the horizontal sheaves 67, 68 are located at the upper horizontal bar 71 of the lifeboat davit 14. The brake of the wire rope winch 45 can be released if a brake lever 54 is hoisted. The brake can be released from the inside of the lifeboat 1 by a control wire rope 55 or manually from the position of the winch 45. The lowering of the lifeboat 1 can be stopped any time by the control wire rope 55. The control wire rope 55 operates from a control wire rope drum 46 of the winch 45 to the inside of the lifeboat 1 on the sheaves 56, 57, 58 and 59 wherein the sheaves 56 and 58 are located at a winch holder 63, the sheave 57 is located at the brake lever 54 of the winch 45, and the sheave 59 is located at the holder 64 at the upper horizontal bar 71 of the lifeboat davit 14. There is a weight 60 and a control rope 61 at the end of the control wire rope 55. The control rope 61 goes to the inside of the lifeboat 1 through a hole 62. The control wire rope 55 of the winch 45 brake for the lifeboat 1 is symmetrical to the control wire rope 48 of the winch 23 brake for the lifeboat davit 14. The control wire rope 55 is located at the opposite side of the lifeboat 1 in relation to the control wire rope 48.

The off load mechanism releases the lifeboat 1 when the lifeboat 1 is in water. The two hooks 3 can be released from two spreader chains 37 by a central release unit handle. The handle of the central release unit should be moved to the release position in order to release the lifeboat 1. The handle of the central release unit is unlocked once the lifeboat 1 is water born by the hydrostatic unit. When the lifeboat 1 is above sea level, the handle of the central release unit can be moved to the release position in order to release the lifeboat 1 only if the additional lock is manually removed. This is an on load procedure releasing the lifeboat 1 and it also constitutes the protection of the lifeboat launching system against any accidental release of the lifeboat 1 from the spreader chains 37 when the lifeboat 1 is above sea level. The hooks 3 can be disengaged by the on load procedure in case of a hydrostatic unit failure. The hooks 3 can be manually disengaged in case of the off load mechanism failure, but only if permitted by weather or any specific situation.

The lifeboat 1 can be lifted from sea, put into the garage 38 and stored at the ramp 12 in the position ready to launch by the lifeboat wire rope winch 45, the lifeboat davit 14, the wire rope winch 23, and the auxiliary wire rope winch 87.

The lifeboat 1 can be lifted from sea to the initial height if two spreader chains 37 are attached to two respective lifeboat hooks 3. The initial height is marked by the power supply limit switch 75 of the lifeboat wire rope winch 45. The lifeboat 1 can be lifted till the power supply for the lifeboat wire rope winch 45 is not cut. The power supply for the winch 45 is cut by the power supply limit switch 75. A weight 76 is attached to a wire rope 77 of the power supply limit switch 75. The power supply for the winch 45 will be cut if the weight 76 is moved up by the spreader 36 and afterwards the wire rope 77 tension is released.

The lifeboat 1 can be put into the garage 38 by the lifeboat 1 davit 14 and the wire rope winch 23. The lifeboat 1 davit 14 lock should be released before starting the operation. The storage position of the lifeboat 1 inside the garage 38 is marked by the power supply limit switch 22 for the lifeboat davit winch 23. The power supply for the lifeboat 1 davit 14 winch 23 will be cut if the upper telescopic hydraulic cylinder 19 is completely closed.

The lifeboat 1 is stored at the ramp 12 in the position ready to launch by the auxiliary wire rope winch 87. The wire rope 88 of the auxiliary winch 87 allows attaching the aft hook 4 of the lifeboat 1 to the chain 9. The lifeboat 1 can be pulled into the garage 38 and held at the ramp 12 by the wire rope 88 of the auxiliary winch 87. A turnbuckle 10 of the chain 9 is connected to a structure 11 of the ramp 12. The length of the chain 9 can be adjusted by the turnbuckle 10. The wire rope 88 of the auxiliary winch 87 can be released from the lifeboat hook 8 and the lifeboat 1 can be stored at the ramp 12 in the position ready to launch if both brakes of the lifeboat 1 winch 45 and the auxiliary winch 87 are released.

Owing to this invention, the off load mechanism for the hook 4 of the free fall lifeboat launching system and the off load mechanism for the hooks 3 of the lifeboat launching gravity system with the use of the fall 66 can be tested, if the lifeboat 1 position is secured at the ramp 12 by the auxiliary winch 87 wire rope 88.

Owing to this invention, also the test of the lifeboat vertical rollers 6 by the auxiliary wire rope winch 87, and the test of the lifeboat 1 departure from the garage 38 by the lifeboat 1 davit 14, and the test of the lifeboat 1 lowering by the wire rope winch 45 can be carried out even if the lifeboat 1 is unmanned It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A launching arrangement for a lifeboat from an offshore installation, comprising:

a garage for the lifeboat;

a gate of the garage that can be opened by gravity;

the lifeboat can be launched either as a free fall lifeboat or by a fall of a lifeboat winch in case of an emergency situation and while a power supply is off; and wherein the garage is equipped with the gate with a wire rope winch, a lower hydraulic cylinder, and an upper hydraulic cylinder; the gate of the garage opens by gravity by simultaneous operation of the wire rope winch of the gate and the lower hydraulic cylinder and the upper hydraulic cylinder, both hydraulic cylinders working as a closed hydraulic system; and the lower hydraulic cylinder and the upper hydraulic cylinder comprise piston rods.

2. The launching arrangement of claim 1, wherein the lower hydraulic cylinder and the upper hydraulic cylinder comprise piston rods in contact with two opposite ends of a gear bar.

3. The launching arrangement of claim 2, wherein the gear bar operates together with a gearwheel of a gate axle by an additional gearwheel.

4. The launching arrangement of claim 1, wherein the piston rods set a movement speed for opening of the gate.

5. The launching arrangement of claim 1, wherein the lifeboat comprises two triangular frames.

6. The launching arrangement of claim 5, wherein the triangular frames cooperate with the fall of the lifeboat winch.

7. The launching arrangement of claim 6, wherein the triangular frames comprise a pair of hooks of a release gear such that the lifeboat is attached by a pair of chains of a davit spreader by the pair of hooks.

8. The launching arrangement of claim 7, wherein the release gear is connected to a central release unit of the pair of hooks of the lifeboat by a release cable.

9. The launching arrangement of claim 1, wherein the lifeboat comprises vertical rollers and horizontal rollers.

10. The launching arrangement of claim 9, wherein the vertical rollers provide lifeboat movement through a ramp and the horizontal rollers provide stabilization of lifeboat movement through the ramp.

11. The launching arrangement of claim 1, wherein lifeboat launching by the fall of the lifeboat winch comprises simultaneous operation of a lifeboat davit wire rope winch and the lower hydraulic cylinder and the upper hydraulic cylinder of the closed hydraulic system.

12. The launching arrangement of claim 11, wherein the lower hydraulic cylinder and the upper hydraulic cylinder are in line with a lifeboat davit.

13. The launching arrangement of claim 12, wherein a forehead of the lower hydraulic cylinder and the upper hydraulic cylinder contacts the lifeboat davit on a pair of sides.

14. The launching arrangement of claim 13, wherein the telescopic hydraulic cylinder and the upper hydraulic cylinder set a movement speed for the lifeboat davit.

* * * * *